US005652416A

United States Patent [19]

Sharaf et al.

[11] Patent Number: 5,652,416

[45] Date of Patent: Jul. 29, 1997

[54] MECHANICALLY HELD ELECTRICALLY OR MANUALLY OPERATED SWITCH

[75] Inventors: Nadir Sharaf; Michael T. Hegland, both of Mounds Veiw, Minn.

[73] Assignee: Onan Corporation, Minneapolis, Minn.

[21] Appl. No.: 562,175

[22] Filed: Nov. 22, 1995

[51] Int. Cl.[6] ..... H01H 9/26; H01H 3/16

[52] U.S. Cl. ..... 200/5 R; 200/47

[58] Field of Search ..... 200/1 R, 4, 5 R, 200/5 E, 16 R, 18, 47, 51.05; 335/6, 7, 11, 126, 189, 206

[56] References Cited

U.S. PATENT DOCUMENTS

| | | | |
|---|---|---|---|
| 1,720,189 | 7/1929 | Jackson . | |
| 2,890,393 | 6/1959 | Coppola . | |
| 2,973,670 | 3/1961 | Dameron . | |
| 3,154,662 | 10/1964 | Heupel et al. . | |
| 3,158,761 | 11/1964 | Bullock . | |
| 3,246,100 | 4/1966 | Russell | 200/92 |
| 3,636,368 | 1/1972 | Sia | 307/64 |
| 3,654,484 | 4/1972 | Jorgenson et al. | 307/149 |
| 3,943,416 | 3/1976 | Degenhart | 317/154 |
| 4,096,368 | 6/1978 | Grebner | 200/314 |
| 4,104,494 | 8/1978 | Swann | 200/243 |
| 4,132,968 | 1/1979 | Lang | 335/16 |
| 4,245,140 | 1/1981 | Jencks et al. | 200/153 |
| 4,328,885 | 5/1982 | Zouzoulas | 200/47 |
| 4,423,336 | 12/1983 | Iverson et al. | 307/64 |
| 4,999,598 | 3/1991 | Jannesari et al. | 335/122 |
| 5,027,096 | 6/1991 | White et al. | 335/202 |
| 5,281,779 | 1/1994 | Bogovican et al. | 200/5 R |
| 5,296,660 | 3/1994 | Morel et al. | 200/146 R |

OTHER PUBLICATIONS

"Unraveling the Mysteries of Linear Motors", Mark Wilson 9/93, Motion Expo '93 Fall.

*Primary Examiner*—Matthew V. Nguyen

*Attorney, Agent, or Firm*—Merchant, Gould, Smith, Edell, Welter & Schmidt, P.A.

[57] ABSTRACT

An electric transfer switch includes a linear actuator operable to switch a plurality of movable contacts from a normal power supply to a standby emergency power supply, when the normal power supply has a power outage, so as to continuously serve electricity to electric loads. A plurality of leaf springs and an offset linkage angle help prevent any incidental disconnection between the moveable contacts and the stationary contacts. The transfer switch also includes a magnetic strip. The magnetic strip is magnetized when there is a "fault" current passing by the contact tips of the moveable and stationary contacts. The attractive force between the magnetic strip and the moveable contacts due to the magnetization overcomes the repulsive force caused by the "fault" current so as to make the contact between the moveable contacts and the stationary contacts unopenable. The transfer switch further includes a plurality of limit switches each of which is open or closed by a protrusion disposed on a crossbar carrying the moveable contacts.

6 Claims, 8 Drawing Sheets

MECHANICALLY HELD ELECTRICALLY OR MANUALLY OPERATED SWITCH

FIELD OF THE INVENTION

The present invention relates to an electric transfer switch, more particularly, to mechanically held electrically or manually operated switch having a linear actuator.

BACKGROUND OF THE INVENTION

A typical electric transfer switch (or circuit beaker) is used to switch electric loads from a normal main utility power supply to a standby emergency power supply when a power outage occurs caused by a variety of reasons, for example, earthquake, flooding, bombing, or other utility blackouts. When the power outage is over, the switch is also used to switch electric loads from the standby emergency power supply back to the normal main utility power supply.

In an electric transfer switch, one of the concerns is to control the transition time in switching from the main power supply to the standby emergency power supply. For example, it may be necessary to disconnect loads from both electric power supplies for a controllable time period to allow residual electricity to dissipate or discharge before being switched to the standby emergency power supply so that the transferred loads are appropriately switched over. Accordingly, the switch is in a neutral position for a controllable period of time, whereby the electric loads do not electrically contact either of the electric power supplies, e.g. the normal power supply and the standby emergency power supply. In other words, a programmed transition mode is provided in which the loads are disconnected with either power supply for a controlled time period.

A typical electric transfer switch is very expensive because many mechanical parts are included and complicated designs are involved. For relatively low power applications (e.g. <200 Amps), a simple and low cost electric transfer switch is needed to switch electric power between a normal power supply and an emergency power supply.

In addition, during a quick make and break operation, the transfer switch opens or closes its moveable contacts with respect to its stationary contacts. After connecting the moveable contacts to the stationary contacts at one closed position, e.g., when the moveable contacts are connected to the normal position or to the emergency position, it is required to lock the transfer switch in the closed position to maintain the contact between the moveable contacts and the stationary contacts. In the closed position, when a "fault" current occurs, it is also required not only to maintain the contact between the moveable contacts and the stationary contacts, but also to lock the moveable and stationary contacts in the closed position so that the repulsive electromagnetic forces at contacts do not open the switch. Accordingly, it is desired to design an electric transfer switch which solves these problems.

U.S. Pat. No. 3,246,100 discloses a load transfer switch mechanism for opening and closing movable contacts of a circuit breaker. However, this transfer switch mechanism includes a complicated mechanical linkage, an electrical motor, and a worm and gear assembly. Further, the switch includes a spring assembly to preload a toggle mechanism so that when the spring assembly reaches over center position, the kinetic energy in the spring assembly causes a rapid change over the contact arms from one stable position to the other stable position. Accordingly, the patent discloses two stable positions and the instant switch between the two stable positions. Therefore, the patented switch does not have a controllable transition period for the switch being a neutral position which disconnects electrical loads from both power supplies to allow residual electricity to dissipate or discharge before being switched to the other power supply.

Therefore, there is a need for an electric transfer switch which overcomes all the above problems. The present invention provides a new, improved, and nonobvious electric transfer switch, which solves these and many other problems associated with existing electric transfer switches.

SUMMARY OF THE INVENTION

The present invention relates to an electric transfer switch, more particularly, to mechanically held electrically or manually operated switch having a linear actuator.

In one embodiment, the present invention comprises a linear actuator with two links so arranged that when the linear actuator is operated, the two links pivot with respect to an actuating rod of the linear actuator and force one set of the moveable contacts unopenably contact the corresponding set of the stationary contacts at one extreme position of the actuating rod. When the linear actuator is actuated in an opposite direction, the actuating rod moves to the other extreme position. The two links pivot, with respect to the actuating rod, one link lifts up the first set of the moveable contacts from the corresponding set of the stationary contacts. Meanwhile, the second link forces the other set of the moveable contacts down to unopenably contact the other corresponding set of the stationary contacts. A switch transfer circuitry controls the operation of the linear actuator. In actuation, the switch transfer circuitry provides a current to the linear actuator which determines the direction and movement of the actuating rod.

Still in one embodiment, when one set of the moveable contacts contact their corresponding stationary contacts, the other set of the moveable contacts disconnect from their corresponding stationary contacts, and the linear actuator is in one of the extreme positions. When the linear actuator is not in the extreme positions (i.e. in a neutral position), both sets of the moveable contacts are disconnected from their corresponding stationary contacts. This provides the switch with a transition time to disconnect the electric loads from both electric power supplies to allow residual electricity to dissipate or discharge before being switched to another power supply. In addition, the transition time is controllable by supplying a current to the linear actuator at a desired time interval.

Yet in one embodiment, the linear actuator includes a linear motor which has a stationary primary and a moving secondary. The moving secondary is the above-mentioned actuating rod. The two links are pivotally mounted on two sides of the actuating rod, respectively. The other end of each link is pivotally mounted on a crossbar which carries a set of the moveable contacts.

Further in one embodiment, an angle defined between the longitudinal center line of the actuating rod and a line joining the two pivot ends of one link decreases when the linear actuator pivots the link toward an extreme position. At the extreme position, the link goes over center and the angle is smaller than 90°, preferably 85°. Further at this point, the link locks against a stop. Thus, the repulsive electromagnetic forces at contacts would not be able to disconnect the moveable contacts from the corresponding stationary contacts. The contacts between the moveable contacts and the stationary contacts are, therefore, not openable in a "fault" current situation.

Still in one embodiment, a leaf spring is mounted between the crossbar and each moveable contact. The leaf springs exert contact pressures to the moveable contacts. While the moveable contacts contact their corresponding stationary contacts at an extreme position, the deflection of the leaf springs apply pressure on the moveable contacts to help prevent any incidental disconnection between the moveable and the stationary contacts and minimize the contact resistance.

Further in one embodiment, the electric transfer switch of the present invention is contained in a housing. The housing has a plurality of blocks and a cover. The moveable and stationary contacts are divided by the blocks into pairs of moveable contacts and pairs of stationary contacts. In each pair of stationary contacts, one stationary contact has a normal power supply terminal which is connected to the normal power supply, and the other stationary contact has a standby emergency power supply terminal which is connected to the standby emergency power supply. The two moveable contacts in each pair of the moveable contacts correspond to the two stationary contacts in each pair of the stationary contacts. The cover of the housing is used to cover at least the linear actuator and the moveable and stationary contacts.

Yet in one embodiment, a magnetic steel strip is mounted on the blocks of the housing and disposed on the bottom side of the moveable contacts. When a "fault" current occurs, the magnetic steel strip is magnetized, and an attractive force is generated between the moveable contacts and the magnetic steel strip. The attractive force overcomes the repulsive forces at contact tips of the moveable contacts and the stationary contacts, thereby eliminating chances of contact disconnections.

In addition, a plurality of limit switches, preferably at least four limit switches, are mounted on the cover of the switch and operated by two crossbars. The limit switches are electrically connected to the linear actuator coils in the housing by electric conductors passing through openings of the cover. The limit switches also connect to outside electricity sources which will provide a current to the linear actuator. Two of the limit switches are normally closed, and the other two are normally open, i.e. when the switch is in the neutral position and is disconnected from either power source.

To operate the switch (from a normal power supply to an emergency power supply), a current flows to one of the closed limit switches so that the linear actuator is actuated until one of the closed limit switches is open. The closed limit switch is opened by a protrusion disposed on the top of the crossbar, whereby the current supplied to the linear actuator is interrupted. Accordingly, the linear actuator stops the movement, and the switch is at the neutral position (without connecting to any power supply). To further operate the switch from the neutral position to the emergency position, a current flows to the other one of the closed limit switches so that the linear actuator is actuated until the other one of the closed limit switches is open. Similarly, the closed limit switch is opened by a protrusion on the top of the other crossbar, whereby the current supplied to the linear actuator is interrupted. Accordingly, the linear actuator stops the movement, and the switch is at the other extreme position where the loads are connected to emergency power supply.

The operation is mirror imaged to bring the transfer switch from the emergency position back to its neutral position and the normal power supply. A current is supplied to one of the then-closed limit switches to actuate the linear actuator to operate the switch from the emergency power supply to the neutral position until this then-closed limit switch is opened by the corresponding protrusion. To further operate the switch from the neutral position to the normal power supply, a current is supplied to the other one of the then-closed limit switches to actuate the linear actuator until this other one of the then-closed limit switches is open by the corresponding protrusion, whereby the current supplied to the linear actuator is interrupted, whereby the switch is connected to the normal power supply.

These and various other advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters generally indicate corresponding parts throughout the following several views.

DETAILED DESCRIPTION OF THE PREFERRED EMBODIMENT

Figure 1:
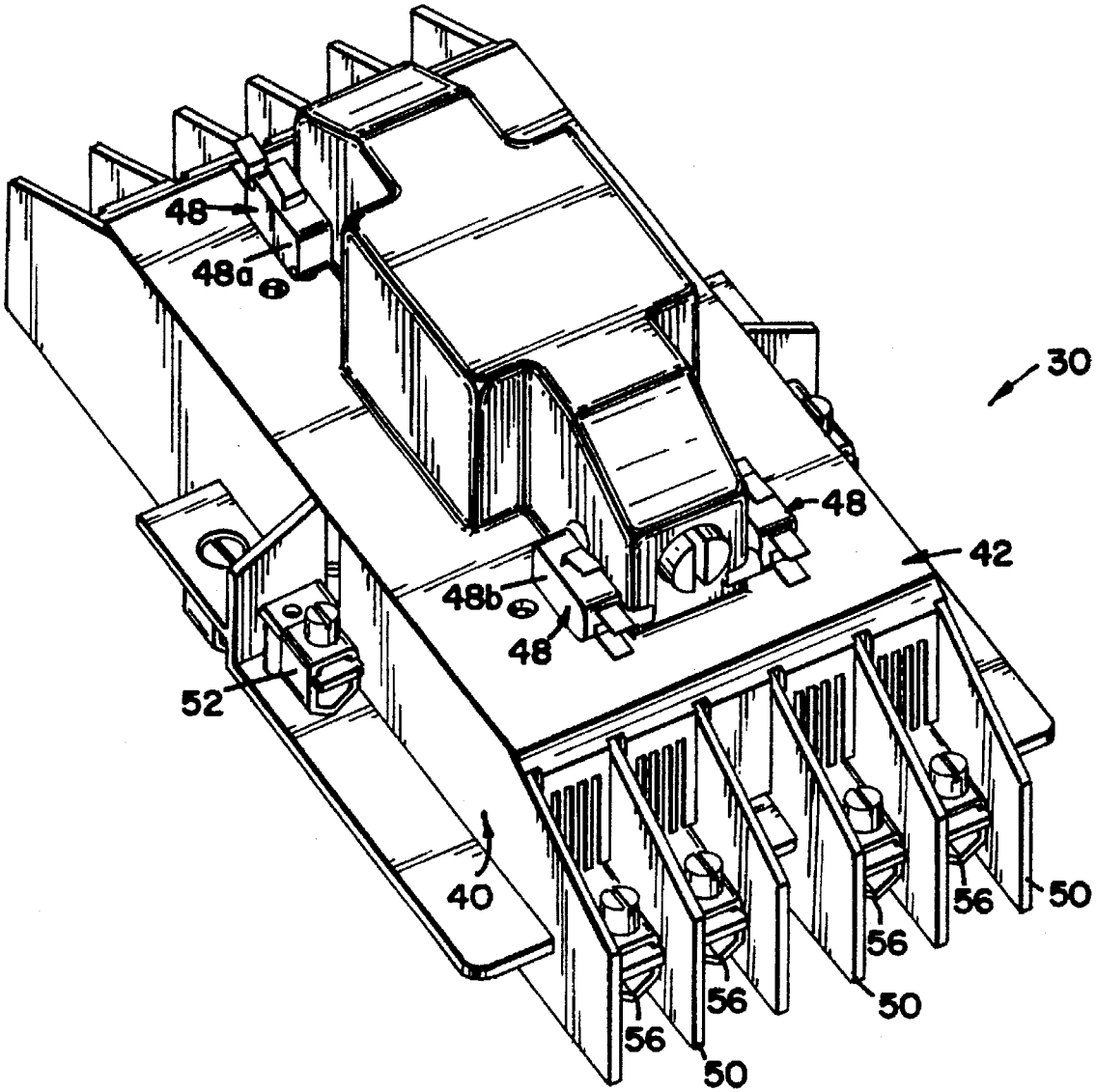
FIG. 1 is a perspective view of an embodiment of an electric transfer switch retained in a housing and having a plurality of limit switches mounted on the housing, generally in accordance with the principles of the present invention.
Figure 7:
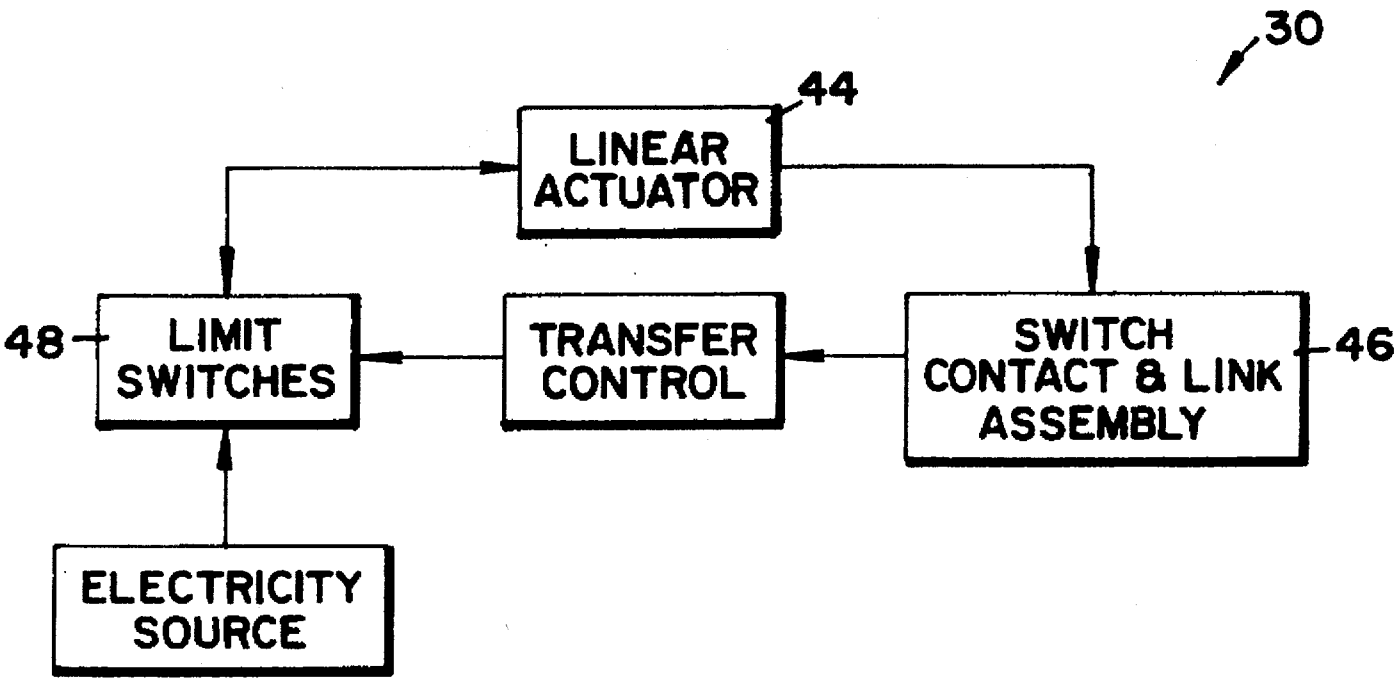
FIG. 7 is a block diagram of the embodiment of the electric transfer switch.

Referring now to the drawings in details, wherein like numerals identify similar elements throughout, FIG. 1 shows an embodiment of an electric transfer switch 30, generally in accordance with the principles of the present invention. The electric transfer switch 30 is retained in a housing 40 which houses a linear actuator 44 (see FIG. 2A) and a switch contact and link assembly 46 (see FIG. 7). A plurality of limit switches 48 are mounted on the cover 42. The limit switches 48 are electrically connected to the linear actuator 44 to activate or deactivate the linear actuator 44. The limit switches 48 includes two normally closed limit switches 48*a*,48*b* and two normally open limit switches 48*c*,48*d*.

Figure 2A:
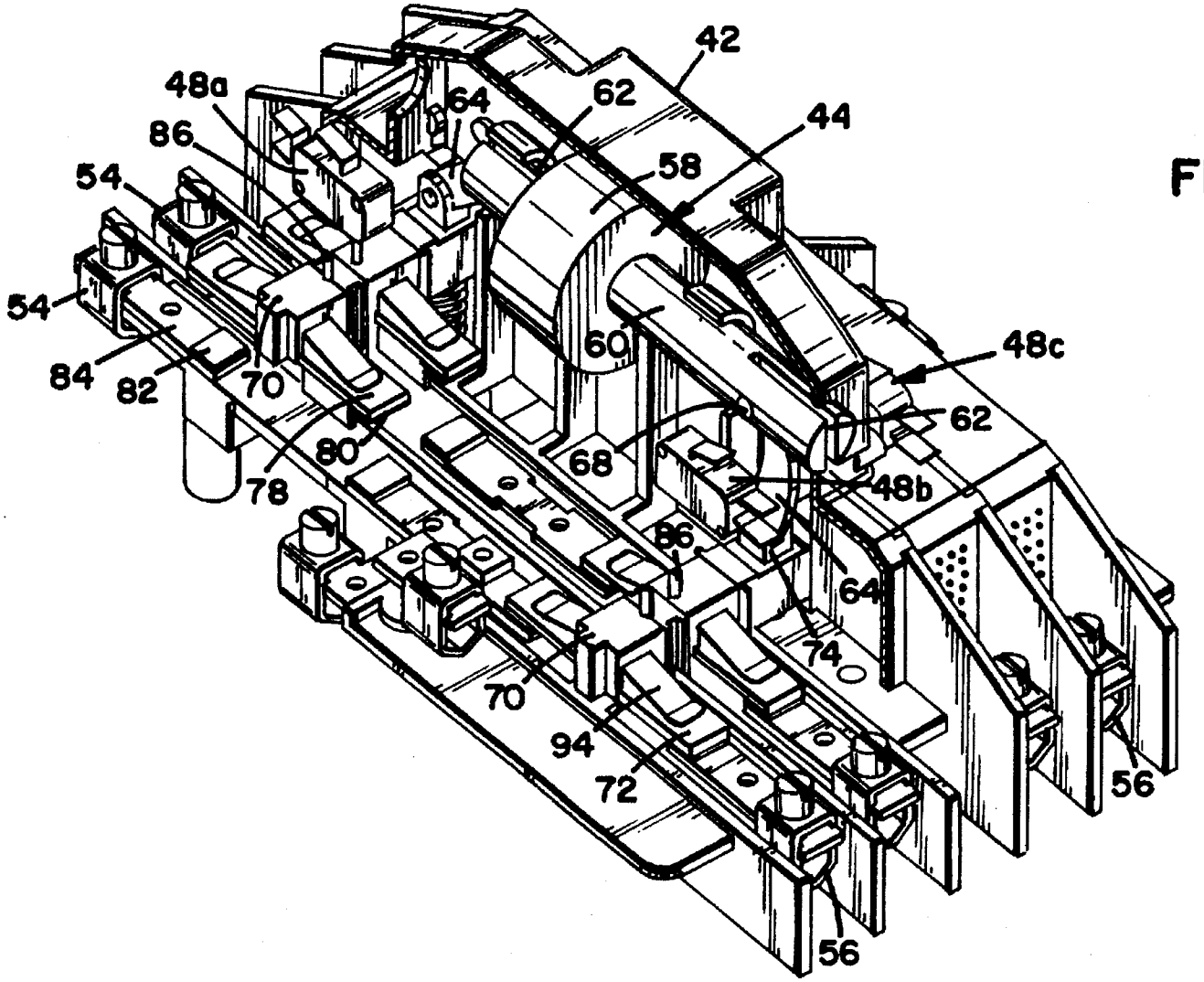
FIG. 2A is a perspective view of the embodiment of the electric transfer switch with a part of the housing removed, which has a linear actuator generally in accordance with the principles of the present invention, wherein the electric transfer switch is connected to an emergency power supply.
Figure 2B:
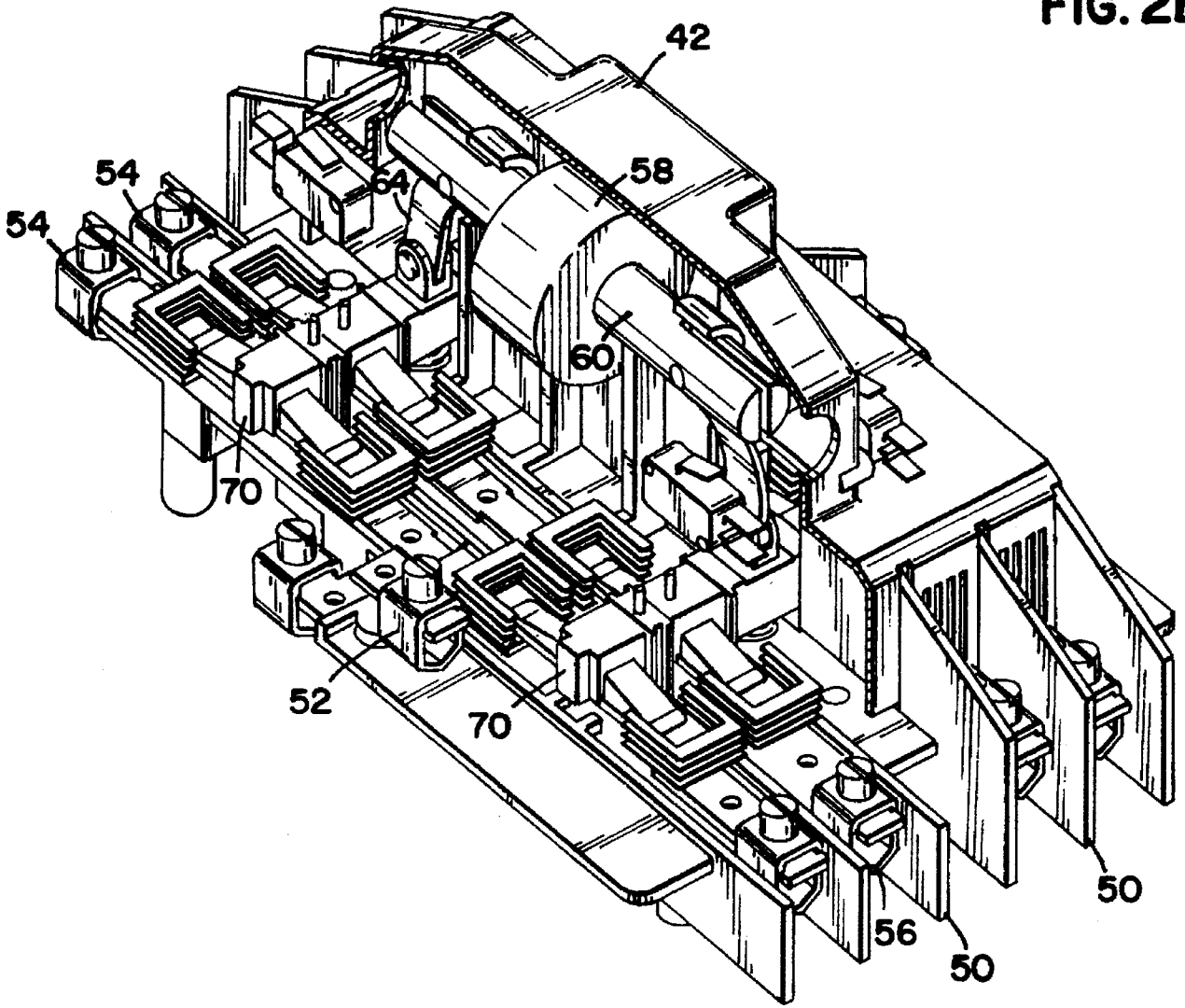
FIG. 2B is a perspective view of the embodiment of the electric transfer switch as shown in FIG. 2A with arc chutes illustrated, wherein the electric transfer switch is in a neutral position.
Figure 3:
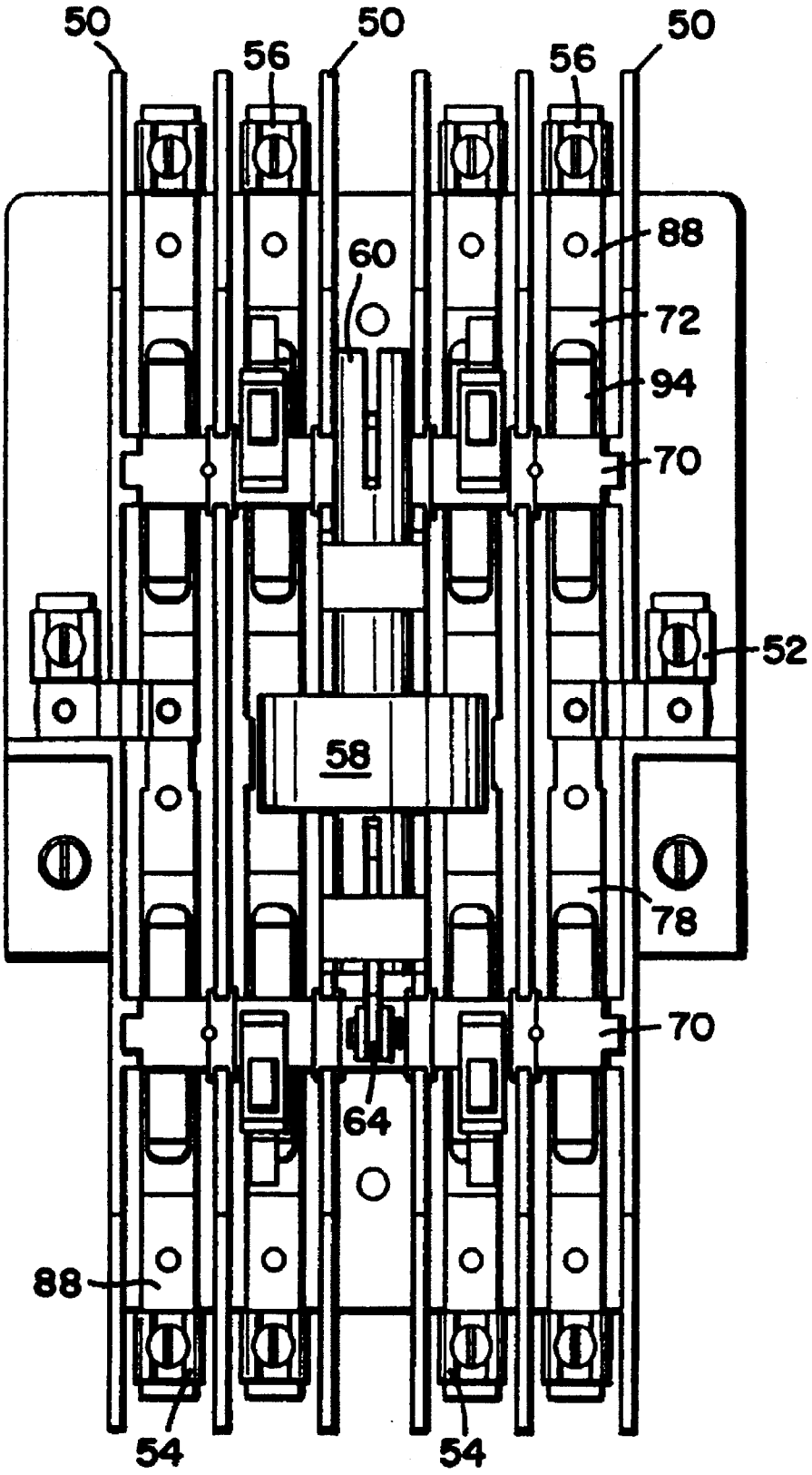
FIG. 3 is a top plan view of the embodiment of the electric transfer switch with the housing removed.

The switch 30 is used to connect electric loads through load terminals 52 to power supplies through power source terminals 54, 56 (see FIG. 2A). The power source terminals 54 are connected to the normal power supplies (not shown), while the power source terminals 56 are connected to the standby emergency power supplies (not shown). The electric loads are normally served by the normal power supplies. In an emergency situation, the electric transfer switch 30 switches from the normal power supplies to the standby emergency power supplies so as to continuously serve the electric loads. Similarly, when the emergency situation is over, the switch 30 is used to switch from the standby emergency power supplies back to the normal power supplies. Further, the terminals 54 or 56 are physically divided by a plurality of walls 50 in housing 40 to avoid interference from each other.

In FIG. 2A, a part of the cover 42 is removed for purposes of illustration. The linear actuator 44 is disposed in the housing 40. The linear actuator 44 includes two magnetic pieces 58, 60. The magnetic piece 58 is a stationary piece which is made of a magnetic core wound by electric windings (not shown). The magnetic piece 60 is a moving piece which is made of a magnetic core. The moving magnetic piece 60 (hereinafter called actuating rod 60) is longitudinally disposed and moves along a central bore of the stationary magnetic piece 58 (hereinafter stationary piece 58).

Figure 6:
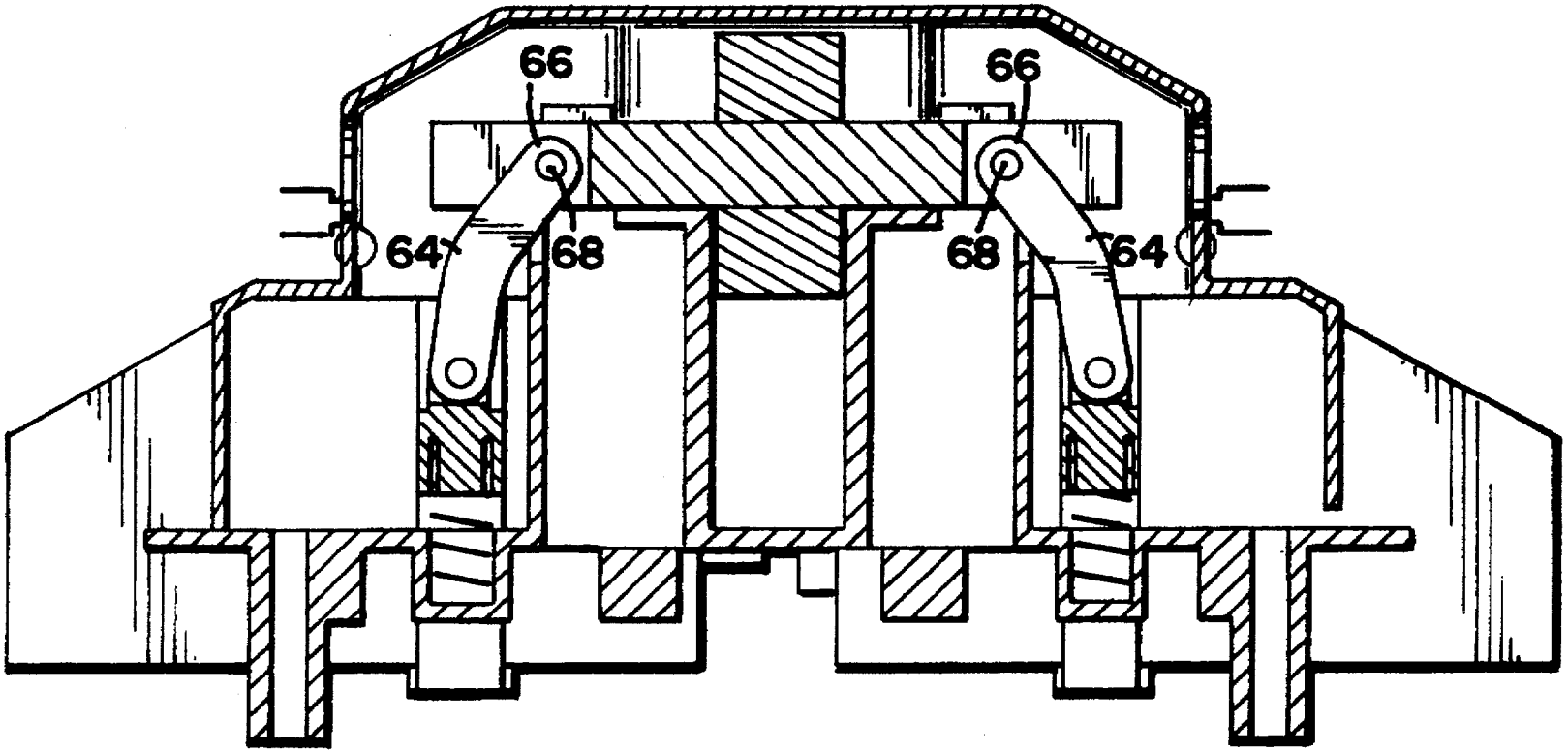
FIG. 6 is a cross-sectional view of the embodiment of the electric transfer switch along A–A' of FIG. 2A but being in the neutral position.

As shown in FIG. 2A, each end side of the actuating rod 60 has a slot 62, whereby a link 64 is pivotally connected to the actuating rod 60. The pivotal end 66 (see FIG. 6) of the link 64 is disposed in the slot 62, and a pivot pin 68 connects the pivotal end 66 to the actuating rod 60. The slot 62 provides a clearance for the pivotal movement of the link 64. Since the slot 62, the link 64, the pivotal end 66 of the link 64, and the pivot pin 68 at one end side of the actuating rod 60 is a mirror image of those at the other end side of the actuating rod 60, the same reference numerals are used for these mirror imaged parts.

Further shown in FIG. 2A, the other end of the link 64 is pivotally connected to a crossbar 70, which carries a first set of moveable contacts 72, through a mounting member 74 and a pivot pin 76. The link 64 on the other side is also pivotally connected to a mirror-imaged crossbar 70, which carries a second set of moveable contacts 78, through a mirror-imaged mounting member 74 and pivot pin 76. Each of the movable contacts 72 has a contact tip 80 which corresponds to a contact tip 82 of a stationary contact 84.

In a normal situation, the moveable contacts 78 contact the stationary contacts 84 that are connected to the normal power supply through the terminals 54. The normally closed limit switch **48*b* is open while the normally open limit switch 48*c* is closed. The actuating rod 60** is off-centered and disposed at a left extreme position (mirror image of FIG. 2A).

Once there is a power outage in the normal power supply, the switch 30 sends a current to the normally open but temporarily closed limit switch **48*c* (i.e., then-closed limit switch) so as to activate the linear actuator 44. The actuating rod 60 is forced to move from the normal power supply (the left extreme position) toward the emergency power supply (the right extreme position) as shown in FIG. 2A. During this process, the moveable contacts 78 are lifted up by the left crossbar 70 in response to the pivotal movement of the left link 64. Meanwhile, the moveable contacts 72 are pushed down by the right crossbar 70 in response to the pivotal movement of the right link 64. This process continues until the protrusion 86 on the top of the right crossbar 70 open up the normally open limit switch 48*c*, and the linear actuator 44 stops in the neutral position where the switch 30 is not connected to either power supply. To further activate the linear actuator 44, an electrical current is supplied through the normally closed switch 48*a*. As the linear actuator 44 moves to the right extreme position (to connect to the emergency power supply), the pivotal movement of link 64 forces the right crossbar 70 down. Thus, the loads are connected to the emergency power supply by the moveable contacts 72. Meanwhile, the left crossbar 70 carrying the moveable contacts 78 for the normal power moves up, and the protrusion 86 on the left crossbar 70 opens the normally closed limit switch 48*a*. Therefore, the electrical current to the linear actuator 44 is terminated, and the movement of the actuator 44 stops. At the right extreme position, the moveable contacts 72 contact their corresponding stationary contacts 88. A contact tip 90 (see FIG. 4) of the moveable contact 72 tightly contacts a contact tip 92 of the stationary contact 88 which connects to the standby emergency power supply through the terminals 56**.

Figure 4:
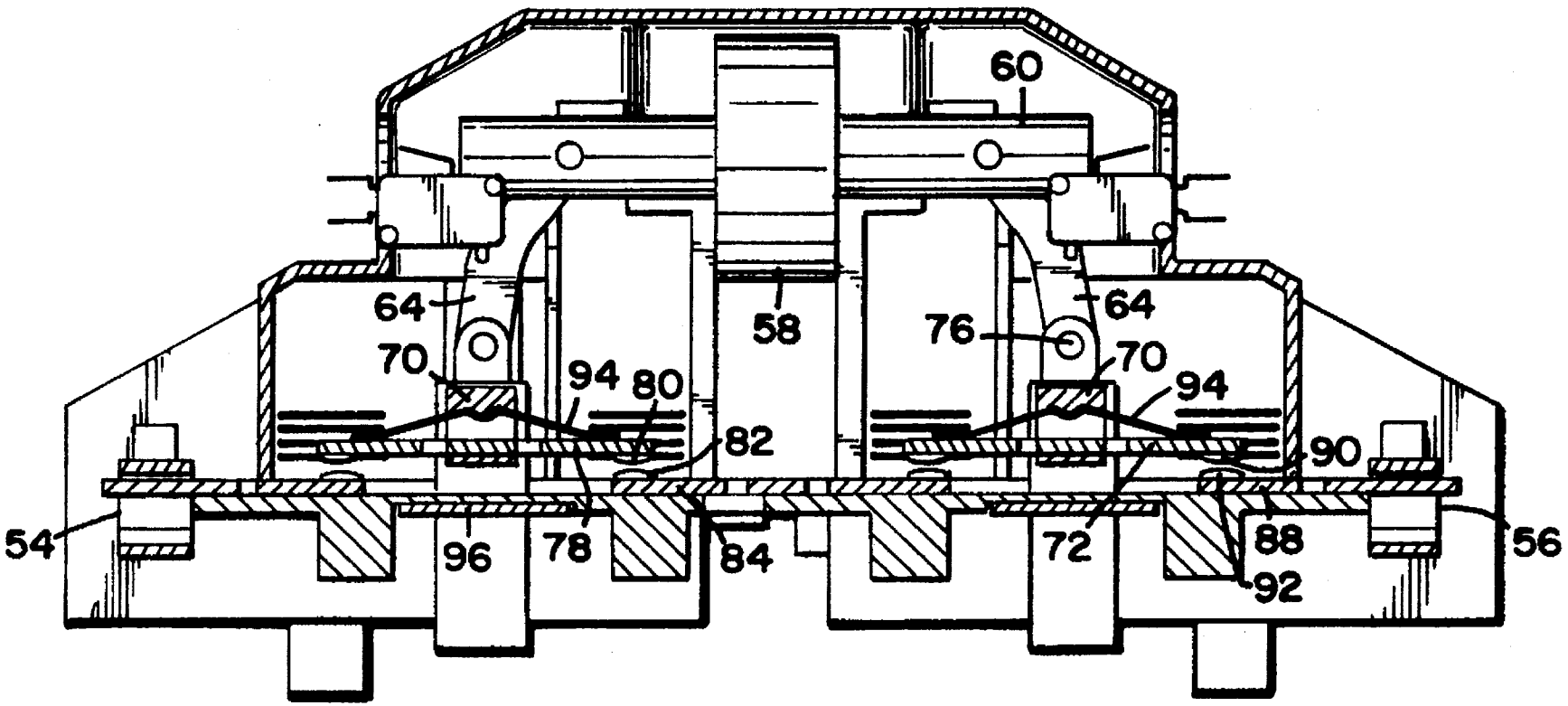
FIG. 4 is an elevated side view of the embodiment of the electric transfer switch as shown in FIG. 2B, in which the linear actuator is in the neutral position.

As shown in FIGS. 1 and 4, a plurality of leaf springs 94 is retained partially in the crossbars 70. Each leaf spring 94 has two legs which biasedly force the moveable contacts 72,78 down when the moveable contacts 72,78 tightly contact their corresponding stationary contacts 88,84, respectively. Accordingly, the leaf springs 94 help prevent any accidental disconnection between the moveable contacts 72,78 and the stationary contacts 88,84, respectively.

A magnetic strip 96 is mounted on walls 50 of the housing 40 on the bottom side. When a "fault" current occurs at the contact tips of the moveable and stationary contacts, the magnetic strip 96 is magnetized, and an attractive force is generated between the moveable contacts 72,78 and the magnetic strip 96. This attractive force overcomes the repulsive force caused by the "fault" current at the contact tips, thereby preventing contact disconnections between the moveable contacts and the stationary contacts.

Once the power outage of the normal power supply is over, the switch 30 sends a current to the normally opened, but temporarily closed, limit switch **48*d* (not shown but behind 48*b* in FIG. 2A) so as to activate the linear actuator 44. The normally open but temporarily closed limit switch 48*d* (then-closed limit switch) causes the linear actuator 44 to be actuated in an opposite direction. Accordingly, the actuating rod 60 is forced to move toward the left extreme position (to connect to the normal power supply). During this process, the moveable contacts 72 are lifted up by the right crossbar 70 in response to the pivotal movement of the right link 64. Meanwhile, the moveable contacts 78 are pushed down by the left crossbar 70 in response to the pivotal movement of the left link 64. This process continues until the protrusion 86 on the top of the right crossbar 70 opens up the normally open, temporarily closed, limit switch 48*d*, and the linear actuator 44 stops at the neutral position where the switch 30 is not connected to either power supply. To further activate the linear actuator 44, an electrical current is supplied through the normally closed switch 48*b*. As the linear actuator 44 moves to the left extreme position, the pivotal movement of the link 64 forces the left crossbar 70 down and thus the loads are connected to normal power source by the moveable contacts 78. Meanwhile, the right crossbar 70 carrying the moveable contacts 72 for emergency power moves up, and the protrusion 86 on the right crossbar 70 opens the normally closed limit switch 48*b*. Therefore, the electrical current to the linear actuator 44 is interrupted, and the movement of the linear actuator 44 stops. At the left extreme position, the moveable contacts 78 contact their corresponding stationary contacts 84. The contact tips 80 of the moveable contacts 78 tightly contact the contact tips 82 of the stationary contacts 84 which connect to the normal power supply through the terminals 54**.

As shown in FIG. 4, the electric transfer switch 30 is in a neutral position whereby none of the moveable contacts 72,78 contact the corresponding stationary contacts 88,84. Accordingly, the switch 30 is provided with a controllable transition time for disconnecting loads from both electric power supplies to allow residual electricity to dissipate or discharge before being switched to another power supply.

Figure 5:
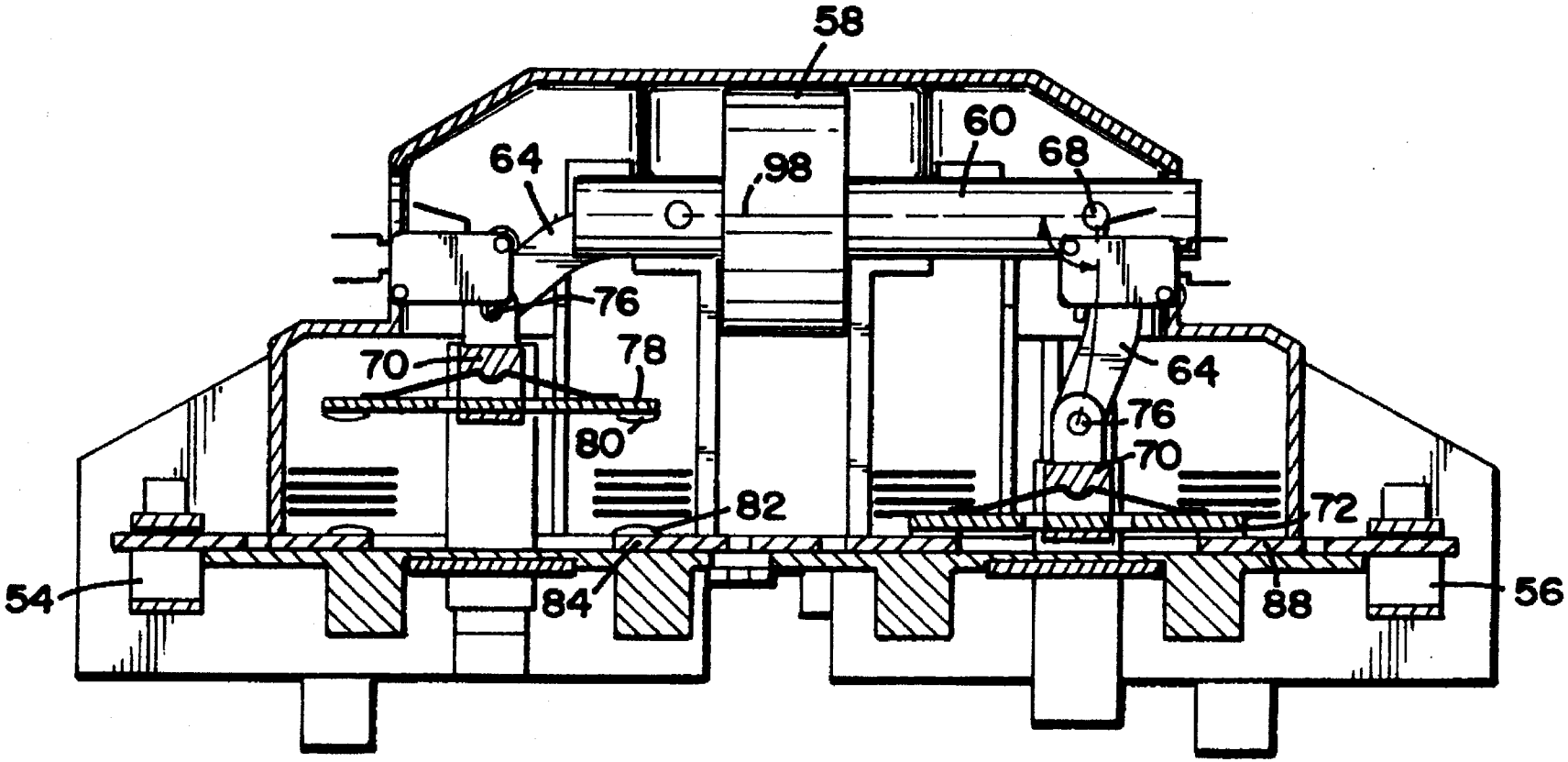
FIG. 5 is an elevated side view of the embodiment of the electric transfer switch as shown in FIG. 2B, in which the linear actuator is in the extreme position.

Further, during the process of moving from the neutral position to an extreme position, for example, the right extreme position as shown in FIG. 5, the angle α defined between the longitudinal axis 98 of the actuating rod 60 and the straight line connecting the two right pivot pins 68 and 76 decreases. When the switch 30 is disposed at the right extreme position, the angle α between the longitudinal axis 98 of the actuating rod 60 and the straight line connecting the two right pivot pins 68 and 76 is smaller than 90°, preferably 85°, as shown in FIG. 5. This off-vertical angle helps force the moveable contacts 72 to tightly contact the stationary contacts 88 because in order for the moveable contacts 72 to disconnect from the stationary contacts 88, the repulsive force has to overcome the offset force built between the right link 64 and the actuating rod 60. The off-centered link 64 is also locked against a stop (not shown).

It will be appreciated that alternate embodiments in keeping with the principles of the present invention might be utilized. It is to be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts, within the principles of the invention, to the full extent indicated by the broad general meaning of the terms in which the appended claims are expressed.

What is claimed is:

1. An electric transfer switch, comprising:

a linear actuator having a stationary piece and a moving piece, the moving piece moving along a central bore of stationary piece;

at least two crossbars, each crossbar carrying a plurality of moveable contacts including a first and a second sets of moveable contacts;

at least two links, each link having two ends, one end of the link pivotally connecting to one end of the moving piece by a first pivot pin, the other end of the link pivotally connecting to a mounting member disposed on one of the crossbars by a second pivot pin;

at least four limit switches, two of which are normally open, and the other two are normally closed;

a plurality of stationary contacts, a first set of the stationary contacts electrically connected to a set of normal power supply terminals, a second set of the stationary contacts electrically connected to a set of emergency power supply terminals, the plurality of stationary contacts corresponding to the plurality of moveable contacts;

wherein the first set of stationary contacts contact the corresponding first set of moveable contacts when the switch is in a normal situation, whereby the linear actuator is in a first extreme position;

wherein in an emergency situation, the linear actuator is actuated by a first current through one of the normally open limit switches which is temporarily closed, the moving piece being moved to a neutral position where said normally open but temporarily closed limit switch is open, the first set of moveable contacts being disconnected from the first set of the stationary contacts, and wherein the linear actuator is further actuated by a second current through one of the normally closed limit switches which is closed, the moving piece being further moved from the neutral position to a second extreme position which is opposite to the first extreme position, the second set of moveable contacts being tightly connected to the second set of the stationary contacts; and wherein when the emergency situation is over, the linear actuator is actuated by a third current through the other normally open limit switch which is temporarily closed, the moving piece being moved from the second extreme position to the neutral position where said other normally open but temporarily closed electrical switch is open, the second set of moveable contacts being disconnected from the second set of the stationary contacts, and wherein the linear actuator is further actuated by a fourth current through the other normally closed limit switch which is closed, the moving piece being moved from the neutral position to the first extreme position, the first set of moveable contacts being tightly connected to the first set of the stationary contacts.

2. An electric transfer switch according to claim 1, wherein the moving piece is longitudinal and has a longitudinal axis, the longitudinal axis and a straight line, connecting between the first and second pivot pins of the link joining the moving piece and the crossbar, define an angle, the angle is smaller than 90° when the linear actuator is at one of the extreme positions.

3. An electric transfer switch according to claim 1, further comprising a plurality of spring members, wherein the spring members are disposed between the moveable contacts and the corresponding crossbars.

4. An electric transfer switch according to claim 1, further comprising a magnetic strip, wherein the magnetic strip is disposed on a bottom side of the moveable contacts, the magnetic strip and the moveable contacts attract to each other when a "fault" current passes by contact tips of the moveable and stationary contacts.

5. An electric transfer switch according to claim 1, wherein the linear actuator includes a linear motor.

6. An electric transfer switch according to claim 1, wherein each of the crossbars includes a protrusion, the protrusion is used to open/close the limit switches during switch operations.

* * * * *